US006588029B2

(12) United States Patent
Mullings

(10) Patent No.: US 6,588,029 B2
(45) Date of Patent: Jul. 8, 2003

(54) SAFETY DRAIN GUARD FOR SWIMMING POOLS AND SPAS

(76) Inventor: Paul M. Mullings, 12022 Royal Palm Blvd., Coral Springs, FL (US) 33065

( * ) Notice: Subject to any disclaimer, the term of this patent is extended or adjusted under 35 U.S.C. 154(b) by 0 days.

(21) Appl. No.: 10/244,801

(22) Filed: Sep. 16, 2002

(65) Prior Publication Data

US 2003/0019025 A1 Jan. 30, 2003

Related U.S. Application Data

(63) Continuation-in-part of application No. 09/927,148, filed on Aug. 10, 2001, now Pat. No. 6,453,482.

(60) Provisional application No. 60/226,261, filed on Aug. 17, 2000.

(51) Int. Cl.[7] ..... E04H 4/00; A47K 1/14

(52) U.S. Cl. ..... 4/507; 4/286; 4/287; 4/288; 4/292; 4/DIG. 14

(58) Field of Search ..... 4/507, 504, 286–292, 4/DIG. 14, 671, 673; 285/191; 210/163

(56) References Cited

U.S. PATENT DOCUMENTS

| | | | | | |
|---|---|---|---|---|---|
| 1,494,882 | A | * | 5/1924 | Barger | 4/292 |
| 1,618,679 | A | * | 2/1927 | Schifter | 4/292 |
| 1,880,962 | A | * | 10/1932 | Koppelman | 4/309 |
| 3,287,742 | A | * | 11/1966 | Gaddis | 4/679 |
| 3,377,634 | A | * | 4/1968 | Patterson | 4/290 |
| 3,392,844 | A | * | 7/1968 | Decarie | 4/292 |
| 3,529,723 | A | * | 9/1970 | Hagedorn | 210/163 |
| 3,742,524 | A | * | 7/1973 | Ballentine | 4/286 |
| 3,858,612 | A | * | 1/1975 | Van Steenburg | 4/287 |
| 4,134,162 | A | * | 1/1979 | Sharland et al. | 4/292 |
| 4,170,047 | A | | 10/1979 | Corsette | |
| 4,188,674 | A | * | 2/1980 | Mardirosian | 4/292 |
| D254,928 | S | | 5/1980 | Mathis | |
| D256,948 | S | | 9/1980 | Boersma | |
| D286,319 | S | | 10/1986 | Mathis | |
| 4,658,449 | A | | 4/1987 | Martin | |
| D299,522 | S | | 1/1989 | Chalberg | |
| D319,295 | S | | 8/1991 | Ohaus | |
| D333,342 | S | | 2/1993 | Newhard | |
| D341,413 | S | | 11/1993 | Nichols | |
| 5,734,999 | A | | 4/1998 | Nicholas | |
| 5,799,339 | A | | 9/1998 | Perry et al. | |
| 6,165,357 | A | * | 12/2000 | Cormier | 210/163 |

* cited by examiner

*Primary Examiner*—Gregory Huson
*Assistant Examiner*—Khoa Huynh
(74) *Attorney, Agent, or Firm*—Mark D. Bowen, Esq.; Stearns Weaver Miller Weissler Alhadeff & Sitterson, P.A.

(57) ABSTRACT

A safety cover for swimming pool drains for dispersing suction pressure and preventing a person's hair or other body parts from becoming entangled and otherwise preventing injury or death. A generally dome-shaped drain cover is removably affixed to a new and/or existing suction drain using a universal mounting mechanism. The drain cover is preferably circular and includes a peripheral lip, a sidewall, and a segmented dome-shaped top portion. The peripheral lip functions to form a seal with the bottom surface of the pool surrounding the drain, while the sidewall defines a plurality of openings therein and the segmented dome-shaped top portion defines a plurality of segments each of which include a plurality of openings. Each opening incorporates screen mesh material for allowing water to flow therethrough.

5 Claims, 8 Drawing Sheets

SAFETY DRAIN GUARD FOR SWIMMING POOLS AND SPAS

CROSS-REFERENCE TO RELATED APPLICATIONS

This application is a continuation-in-part of U.S. patent application Ser. No. 09/927,148 filed Aug. 10, 2001, now U.S. Pat. No. 6,453,482, which claims the benefit of U.S. provisional patent serial No. 60/226,261, filed Aug. 17, 2000.

STATEMENT REGARDING FEDERALLY SPONSORED RESEARCH OR DEVELOPMENT

N/A

BACKGROUND OF THE INVENTION

1. Field of the Invention

The present invention relates to suction drains for swimming pools and spas, and more particularly to a safety drain guard adapter for attachment to the suction drain of a swimming pool or spa for preventing personal entrapment and injury.

2. Description of Related Art

Swimming pools and spas are popular throughout the world. Most pools and spas are equipped with a single powerful water circulation and filtration system that includes one or more suction drains. These suction drains have been known to entrap persons underwater resulting in death by drowning. Hair entrapment occurs when a person's hair becomes entangled in a suction fitting drain cover as the water and hair are drawn powerfully through the drain. Each year, hundreds of young children die and thousands come close to death due to submersion in residential swimming pools. The United States Consumer Product Safety Commission estimates that each year about 300 children under 5 years old drown in residential swimming pools, and that hospital emergency room treatment is required for approximately another 2,300 children under 5 years of age who were submerged in residential pools. In fact, drowning is recognized as a leading cause of death of children under the age of 5 years in California, Arizona, and Florida. It is recognized that any flat grating that the body can cover completely, coupled with a plumbing layout that allows a buildup of suction if the drain is blocked, presents this hazard. The problem is so severe that some have proposed that all new swimming pools be built with costly two-drain systems as well as other equipment that would ease the powerful suction that can trap a person underwater.

Accordingly, the background art reveals devices intended to ease the powerful suction associated with pool drains. U.S. Pat. No. 4,658,449, issued to Martin, discloses a protective adapter for pool drains having grill work defining a raised screening surface for screening any water flowing into the drain. U.S. Pat. No. 5,734,999, issued to Nicholas discloses a safety device for pool drains having spaced regions with openings through which water can flow into a pool drain. U.S. Pat. No. 5,799,339, issued to Perry et al., discloses a safety cover for suction drains that is unlikely to entangle the hair of a user.

One problem encountered with pool drain devices of the background art is that the structures disclosed tend to interfere with automatic swimming pool cleaning devices which travel along the floor and walls of the pool. More particularly the devices of the background art include structures that are problematic to the operation of automatic pool cleaning devices in that the devices interfere with the travel and/or entangle the automatic pool cleaning devices. Another problem with prior art pool drains involves time-consuming installation due to complex mounting configurations. Accordingly, installation of the prior art devices requires draining of the pool or underwater breathing apparatus to allow the installer to effect the installation.

Accordingly, there remains an urgent need, however, for a protective adapter for pool drains that incorporates a universal mounting configuration providing simple and effective installation to new and/or existing pool drains.

BRIEF SUMMARY OF THE INVENTION

The present invention provides a safety cover for swimming pool drains for dispersing suction pressure and preventing a person's hair from becoming entangled and otherwise preventing injury or death. According to a preferred embodiment of the present invention there is disclosed a generally dome-shaped drain cover that may be removably affixed to a new and/or existing suction drain using a universal mounting mechanism. The drain cover is preferably circular and includes a peripheral lip, a sidewall, and a segmented dome-shaped top portion. The peripheral lip functions to form a seal with the bottom surface of the pool surrounding the drain, while the sidewall defines a plurality of openings therein and the segmented dome-shaped top portion defines a plurality of segments each of which include a plurality of openings. Each opening incorporates screen mesh material for allowing water to flow therethrough. A universal mounting mechanism comprising a rigid bar member adapted for attachment to an existing drain and a generally cylindrical structure adapted for connecting the drain cover to the rigid bar member. In an alternate embodiment for use with square drains, the safety drain cover may be pyramid shaped and have a generally square footprint.

Accordingly, it is an object of the present invention to provide an improved suction drain guard for swimming pools and spas.

Yet another object of the present invention is to provide a suction drain guard adapted for installation in new and/or existing pools and spas.

Still another object of the present invention is to provide a suction drain guard that does not interfere with the operation of automatic pool cleaners.

Yet another object of the present invention is to provide an anti-vortex drain cover.

In accordance with these and other objects which will become apparent hereinafter, the instant invention will now be described with particular reference to the accompanying drawings.

DETAILED DESCRIPTION OF THE INVENTION

Figure 1:
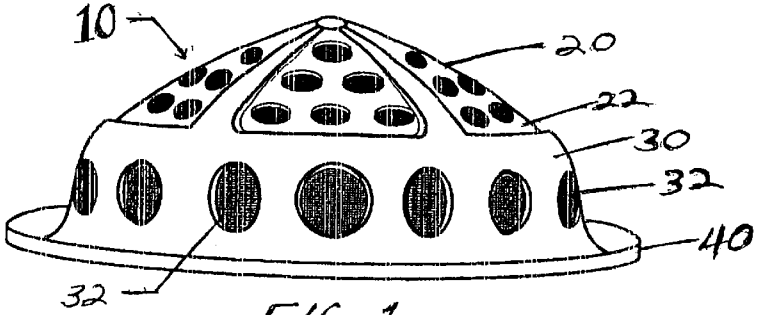
FIG. 1 is a side elevational view of a preferred embodiment of a drain cover according to the present invention.
Figure 2:
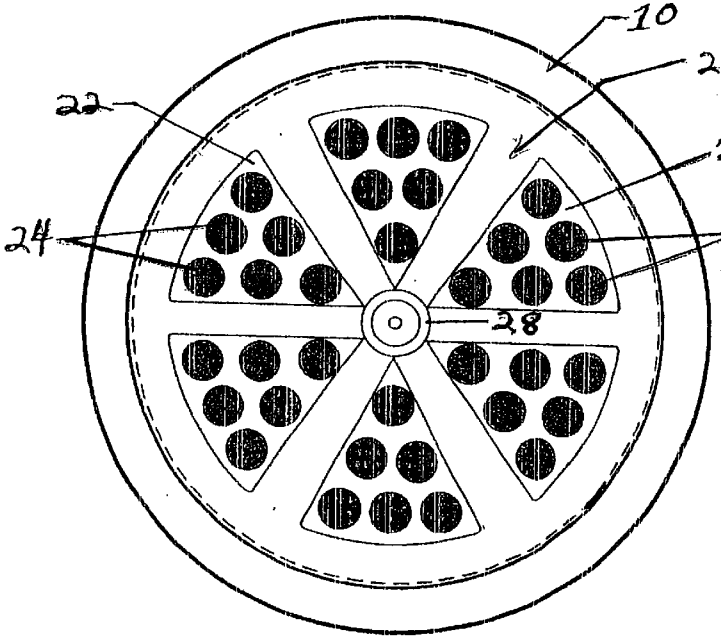
FIG. 2 is a bottom view thereof.
Figure 3:
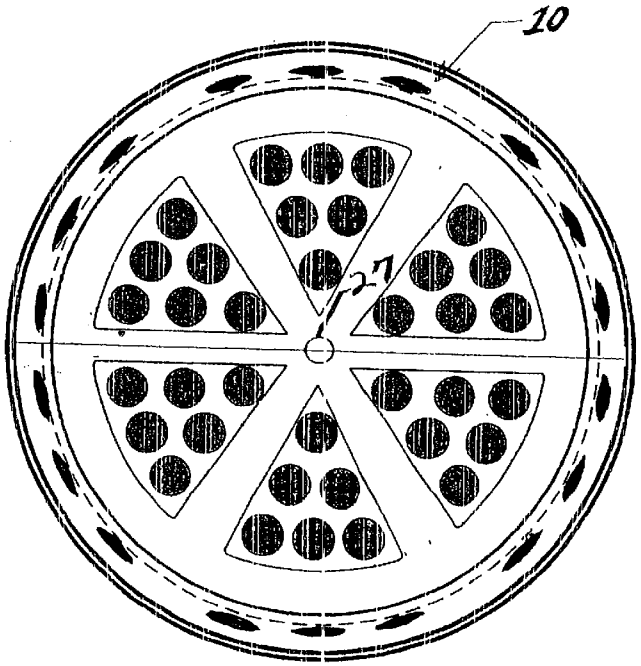
FIG. 3 is a top view thereof.

With reference now to the drawings there is disclosed a safety cover, generally referenced as 10, for installation in connection with swimming pool and spa drains to disperse suction pressure and prevent a person's hair from becoming entangled and otherwise preventing injury or death. FIGS. 1 through 4 depict a preferred embodiment of the present invention for use with round pool drains, and FIGS. 5 through 9 depict an alternate embodiment of the present invention for use with generally square pool drains.

Safety drain cover 10 comprises a drain cover that may be removably affixed to a new and/or existing suction drain using a universal mounting mechanism 50. Drain cover 10 is preferably circular and includes a dome-shaped top portion 20 having substantial segmented openings therein, a sidewall 30, and a flexible downwardly projecting peripheral lip 40. Drain cover 10 is preferably fabricated from molded plastic and/or any other suitable material and is sized to cover conventional suction drain openings.

Drain cover 10 functions as a safety suction drain cover by providing a raised (i.e. non-planar) structure that is not easily blocked by a human body thereby preventing a situation wherein a person would be entrapped by suction. The drain cover further provides a plurality of spaced openings on both the top and sidewall through which water may flow. Drain cover 10 includes a dome-shaped top portion, generally referenced as 20, which defines a plurality of recessed pie-shaped segments 22 each of which defines a plurality of openings 24. The recessed segments thus result in a structure that is resistant to blockage. Openings 24 each incorporate screen mesh material 26 thereby allowing water to flow therethrough. Top portion 20 further defines an aperture 27 and a generally cylindrical collar 28 axially disposed and downwardly projecting from the undersurface thereof for reasons that are described more fully hereinbelow. Drain cover 10 further includes a peripheral sidewall 30 projecting downwardly from the dome-shaped top surface 20. Sidewall 30 defines a plurality of openings 32, which further allow water flow therethrough. Peripheral lip 40 is connected proximate a lower edge portion of sidewall 30. Peripheral lip 40 functions to form a seal between the cover 10 and the bottom surface of the pool surrounding the drain.

Figure 4:
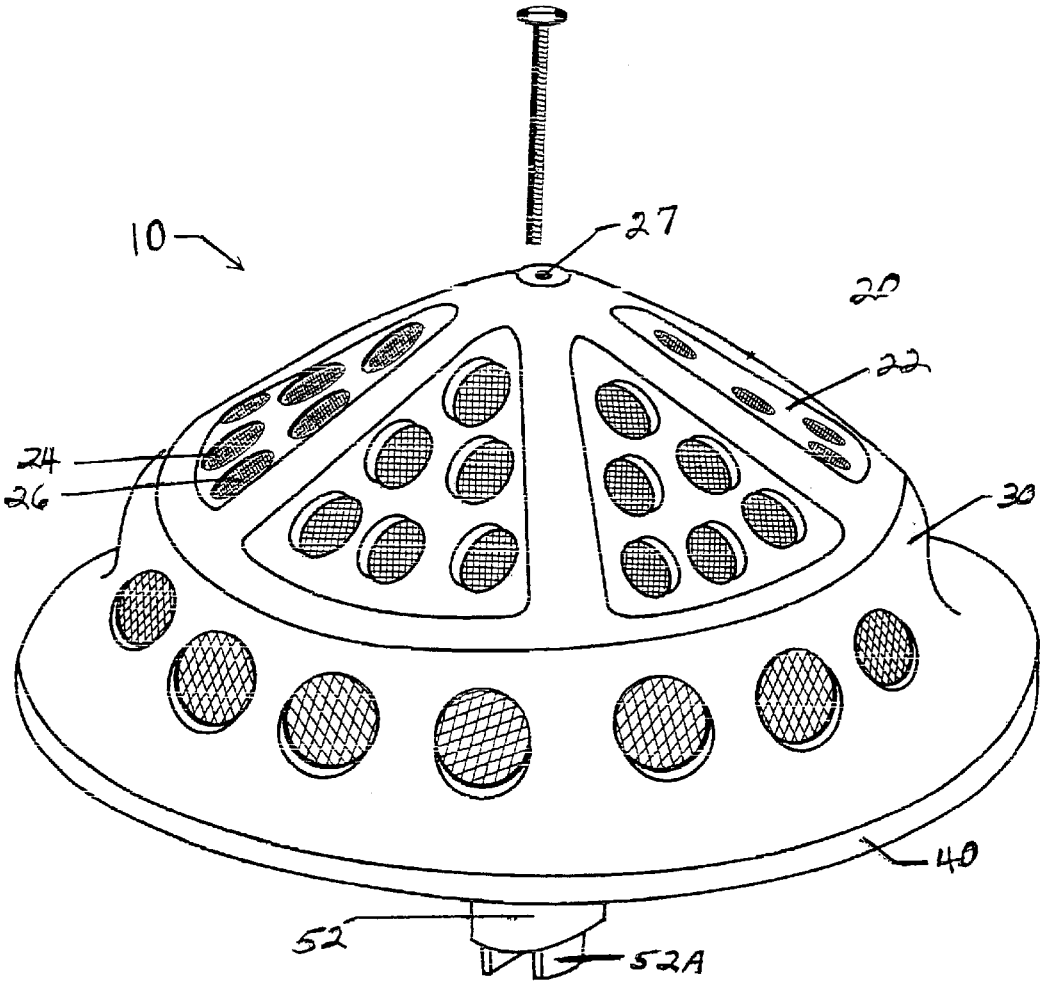
FIG. 4 is an exploded perspective view of a drain cover and mounting component.
Figure 4:
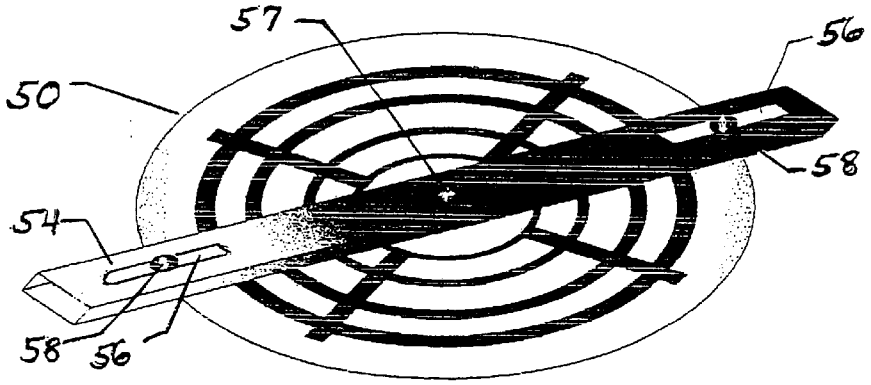
Figure 5:
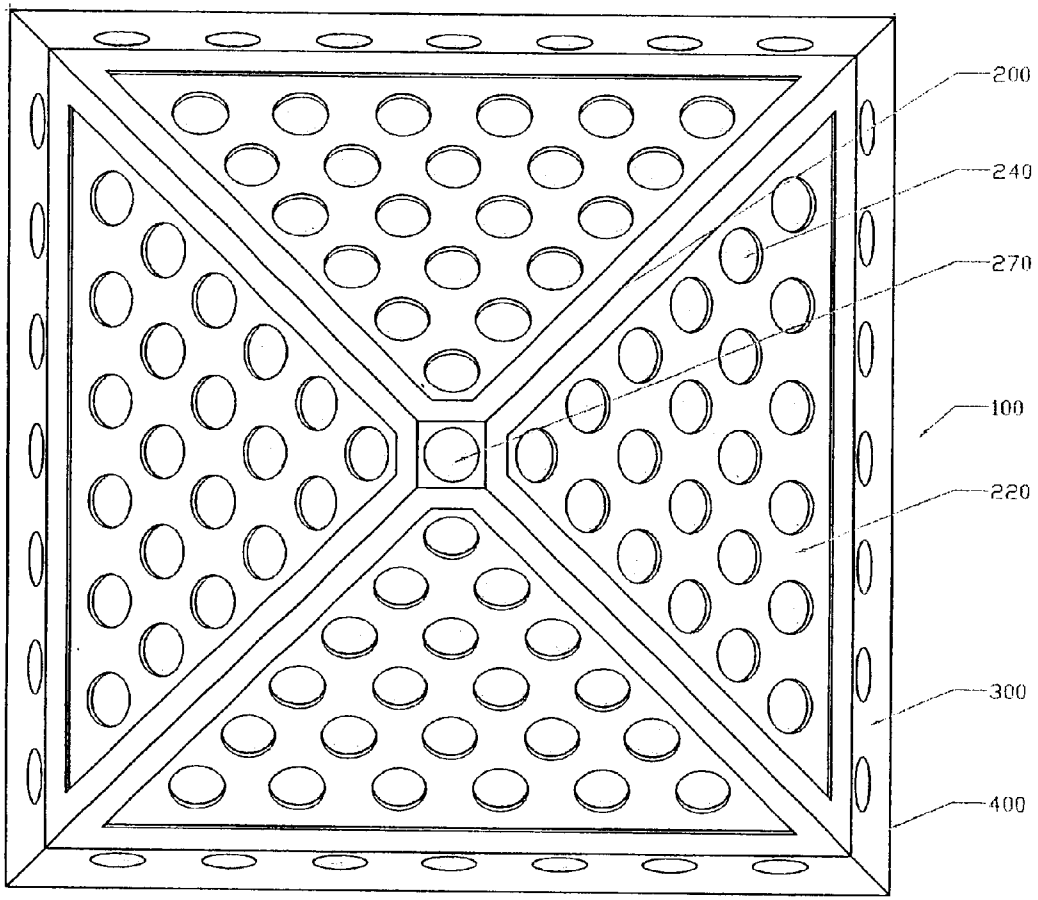
FIG. 5 is a top plan view of an alternate embodiment drain cover for use with square drains.
Figure 6:
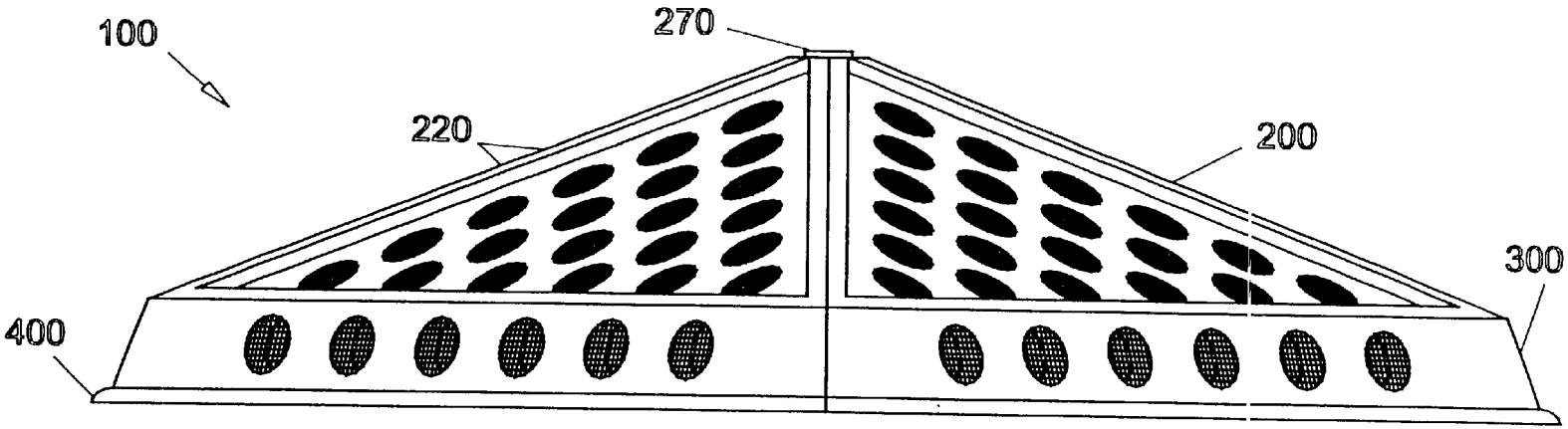
FIG. 6 is a side elevational view thereof.
Figure 7:
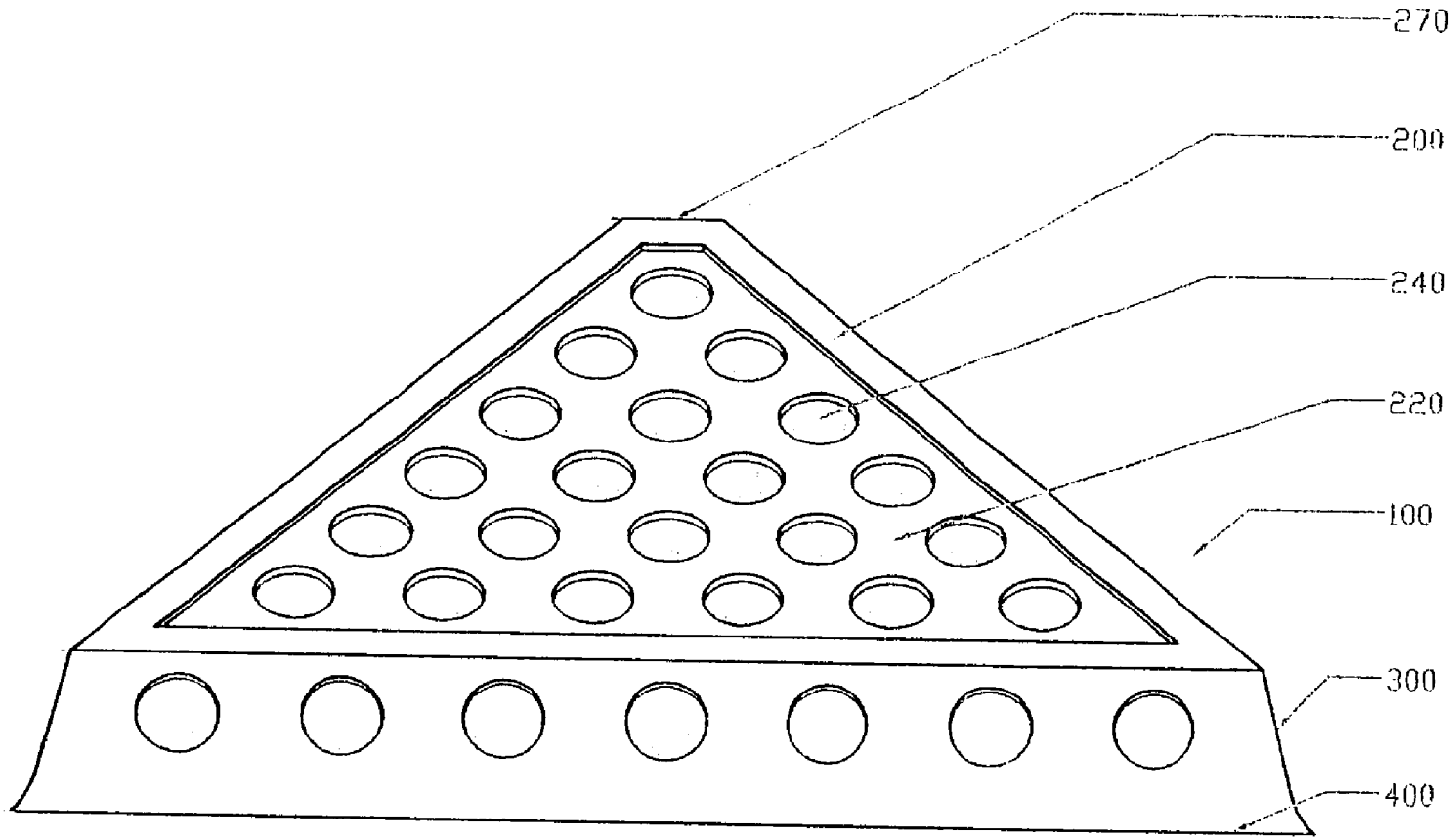
FIG. 7 is a front elevational view thereof.
Figures 8, 9:
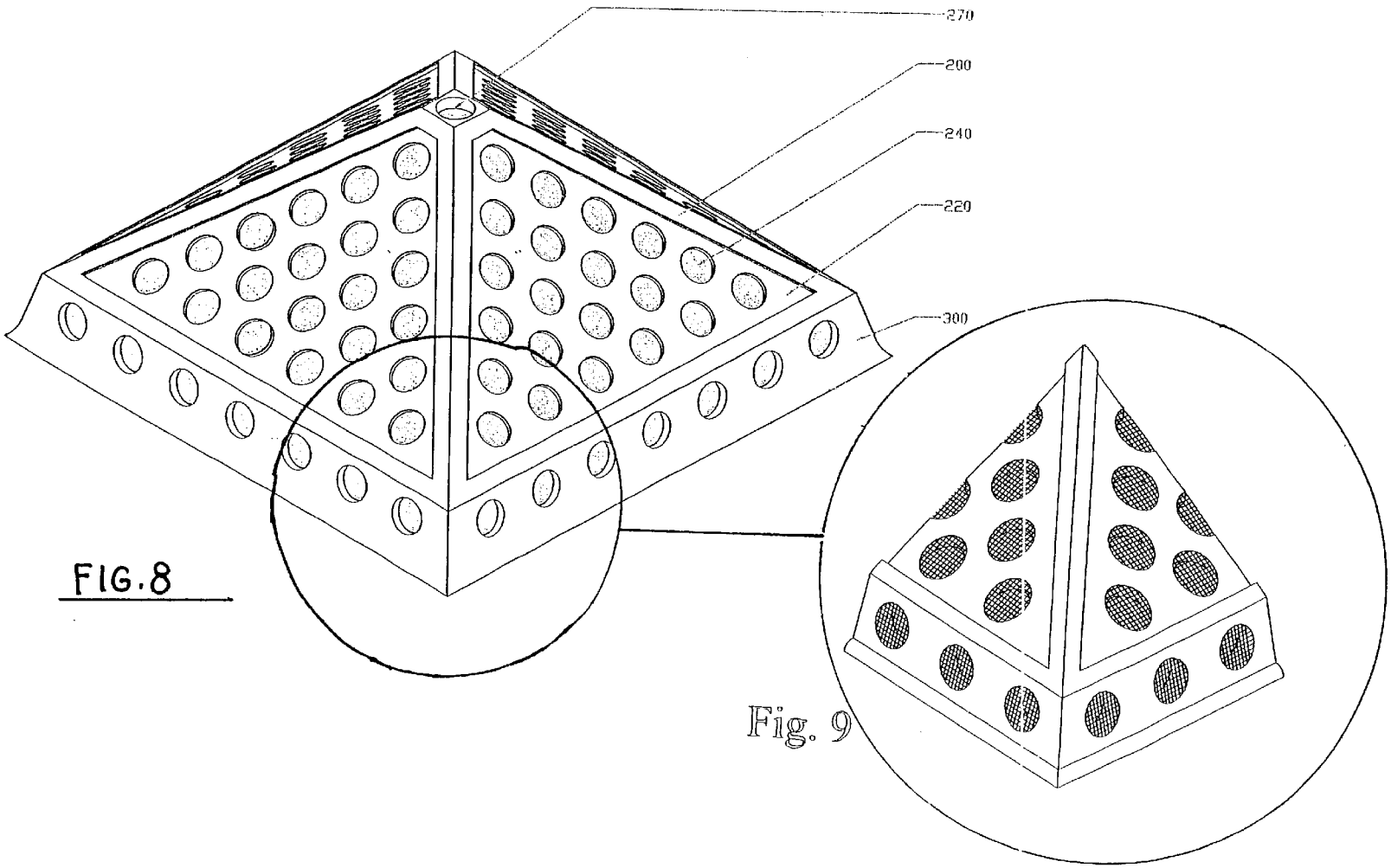
FIG. 8 is a top perspective view thereof.
FIG. 9 is a detail view of a corner portion thereof.

As best seen in FIG. 4, a universal mounting mechanism, generally referenced as 50, provides a mounting structure for drain cover 10 according to the present invention. In a preferred embodiment, mounting mechanism 50 includes a generally cylindrical rigid body 52 and a rigid bar 54. Rigid bar 54 defines a pair of slotted apertures 56 disposed proximal each end thereof and an internally treaded aperture 57 generally centrally disposed between opposing ends thereof. Slotted apertures 56 receive threaded fasteners 58 therein for securely attaching bar 54 directly to an existing pool drain. By incorporating slotted apertures bar 54 is universally adaptable to fit virtually any existing pool drain configuration thereby rendering the invention suitable for use with any pool and/or spa drain. Rigid body 52 is generally cylindrical and is sized for inserted engagement with collar 28 defined on the undersurface of cover 10. Rigid body 52 further includes a plurality of projecting locking legs 52A projecting from an end thereof. Legs 52A are sufficiently spaced for receiving a portion of rigid bar 54 therebetween so as to anchor the drain cover. A threaded fastener 60 is inserted through cover aperture 27 and secured to rigid bar 54 at aperture 57. When installed, rigid body 52 supports the raised drain cover thereby preventing potential collapse due to high suction forces or externally applied forces.

More particularly, installation of a drain cover according to the present invention involves: (1) the secured attachment of rigid bar 54 to a new and/or existing swimming pool drain grate using stainless steel fasteners; (2) connecting rigid body 52 onto bar 54 such that the rigid body is vertically oriented and bar 54 is disposed between legs 52A; (3) lowering safety cover 10 onto rigid body 52 such that a top portion of body 52 is received within collar 28 on the underside of cover 10; (4) securing the cover over the drain using a stainless steel threaded fastener inserted through cover aperture 27 for threaded engagement with bar aperture 57 thereby anchoring the over the pool drain.

FIGS. 5–9 depict an alternate embodiment drain cover, generally referenced as 100 for use with square pool drains. Cover 100 also comprises a drain cover that may be removably affixed to a new and/or existing suction drain using the universal mounting mechanism 50 disclosed hereinabove. Drain cover 100 includes a pyramid-shaped top portion 200 having recessed surfaces 220 defining openings therein, a sidewall 300, and a peripheral lip 400. Drain cover 100 is preferably fabricated from molded plastic and/or any other suitable material and is sized to cover conventional square and/or rectangular suction drain openings.

Drain cover 100 functions as a safety drain cover by providing a raised (i.e. non-planar) water flow inlet structure that is not easily blocked by a human body thereby preventing a situation wherein a person would be entrapped by suction. The drain cover further provides a plurality of spaced water inlet openings 240 on both the top recessed surfaces 220 and the sidewall 300 (apertures 320) through which water may flow. More particularly, drain cover 100 includes a pyramid-shaped top portion, generally referenced as 200, which defines a plurality of recessed triangular-shaped recessed segments 220 each of which defines a plurality of generally circular openings 240. Openings 240 each incorporate screen mesh material 260 thereby allowing water to flow therethrough. Top portion 200 further defines an aperture 270 and a generally cylindrical collar (not shown) axially disposed and downwardly projecting from the undersurface thereof for mounting purposes as described hereinabove. Drain cover 100 further includes a peripheral sidewall 300 projecting downwardly from the pyramid-shaped top portion 200. Sidewall 300 defines a plurality of openings 320, which further allow water flow therethrough. Peripheral lip 400 is connected proximate a lower edge portion of sidewall 300. Peripheral lip 400 functions to form a seal between the cover 100 and the bottom surface of the pool surrounding the drain.

Figure 10:
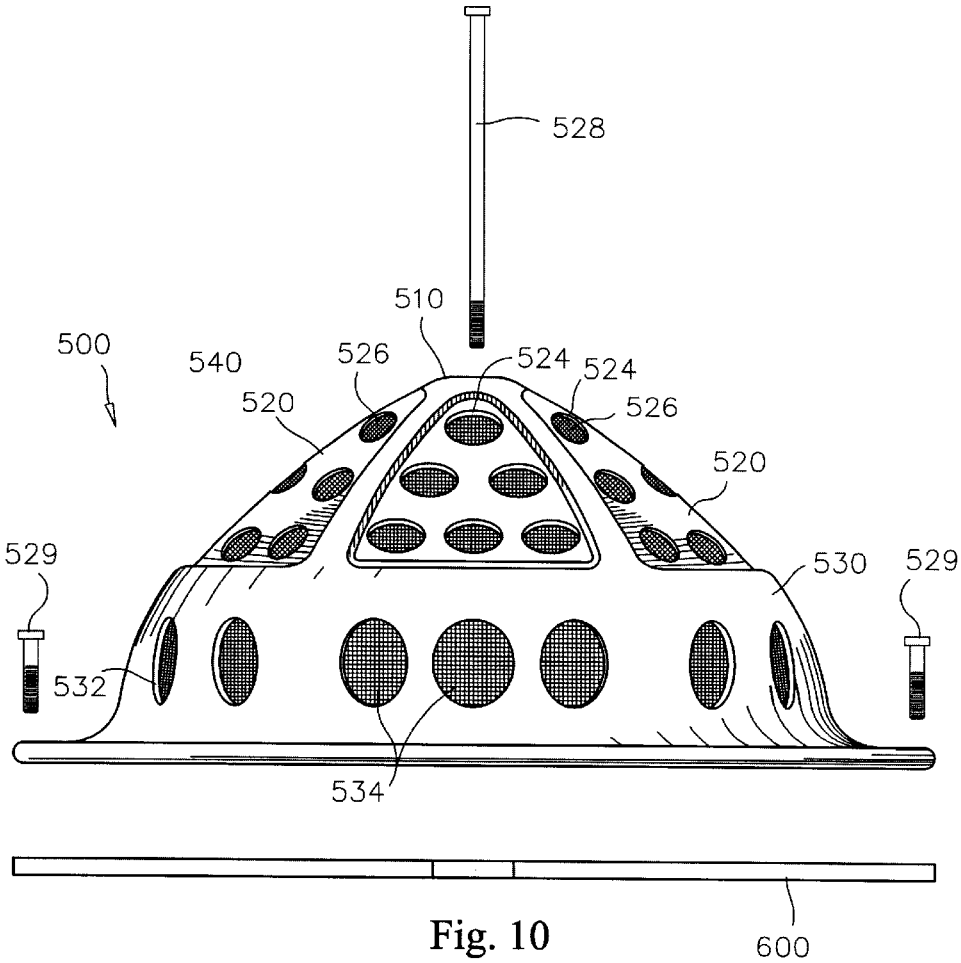
FIG. 10 is a side elevational view of an alternate embodiment circular drain cover and mounting apparatus.

FIG. 10 depicts an alternate embodiment suction drain cover, generally referenced as 500. Drain cover 500 comprises a drain cover that may be removably affixed to a new and/or existing suction drain using an alternate embodiment universal mounting mechanism, generally referenced as 600. Drain cover 500 is preferably circular and includes a dome-shaped top portion 510 having segmented portions 520 defining openings therein, a sidewall 530, and a flexible peripheral lip 540. Drain cover 500 is preferably fabricated from molded plastic and/or any other suitable material and is sized to cover conventional suction drain openings.

Drain cover 500 functions as a safety suction drain cover by providing a raised (i.e. non-planar) structure that is not easily blocked by a human body thereby preventing a situation wherein a person would be entrapped by suction. The embodiment depicted in FIGS. 10 and 11 has a height and/or height to width ratio that is greater than the height depicted for the embodiment depicted in FIGS. 1–4. Drain cover 500 further defines a plurality of spaced openings in each segment 520 of top portion 510 and sidewall 530 through which water may flow. Drain cover 500 includes a dome-shaped top portion, generally referenced as 510, which defines a plurality of recessed pie-shaped segments 520 each of which defines a plurality of openings 524. The recessed segments provide a structure that is resistant to blockage. Openings 524 each incorporate screen mesh material 526 thereby allowing water to flow therethrough. Top portion 510 further defines an aperture 527 for receiving a threaded fastener 528. Sidewall 530 defines a plurality of openings 532, each having screen mesh 534 material therein, which further allow water flow therethrough. A peripheral lip 540 is connected proximate a lower edge portion of sidewall 530. Peripheral lip 540 functions to form a seal between the cover 500 and the bottom surface of the pool surrounding the drain. Peripheral lip 540 is prefereably fabricated from a rubber or soft plastic material.

Figure 11:
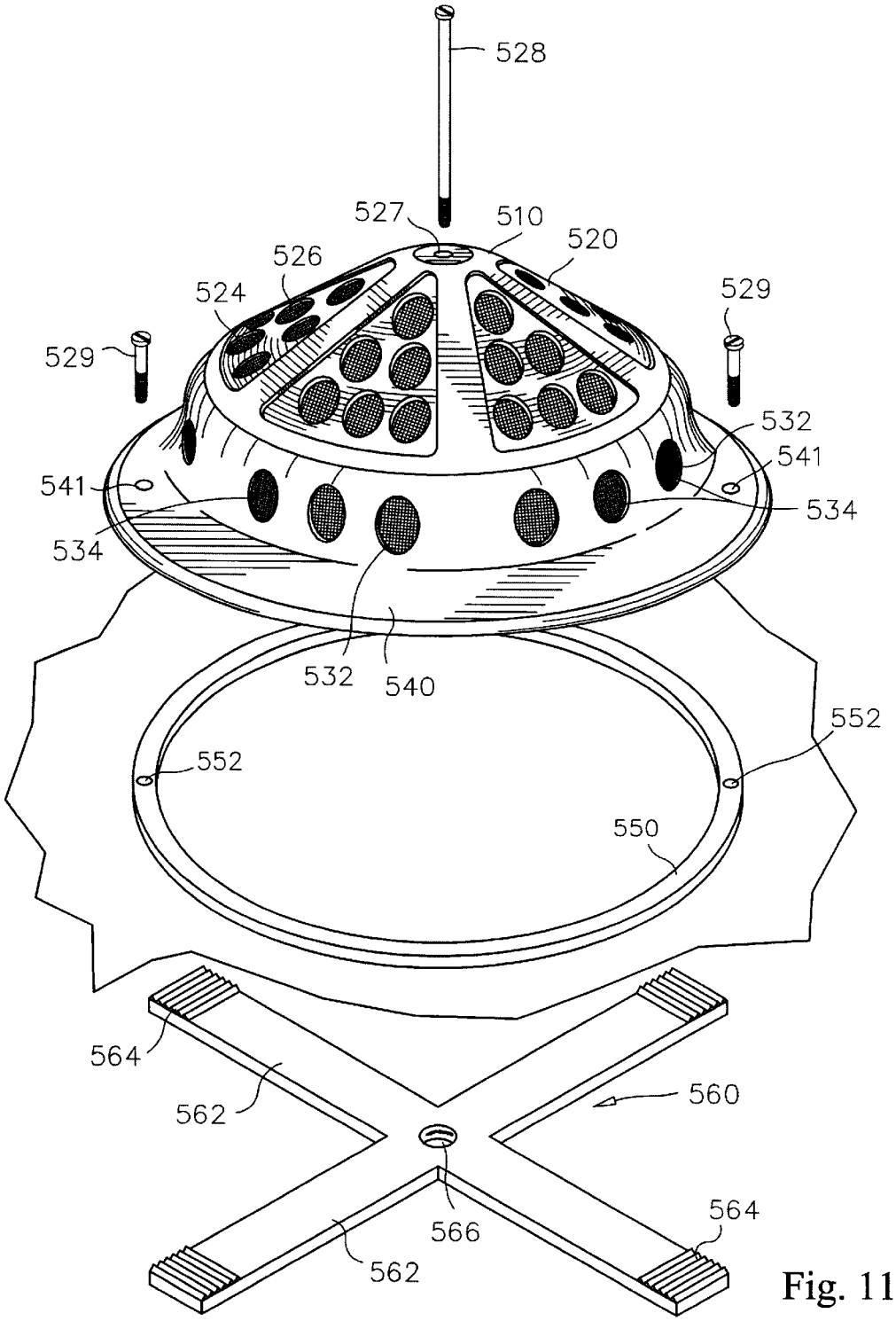
FIG. 11 is a top perspective view thereof in relation to an existing drain mounting ring for a pool drain.

The alternate embodiment drain cover 500 depicted in FIGS. 10 and 11 includes an alternate mounting apparatus to provide a secure attachment between drain cover 500 and a pool drain opening represented by an existing drain cover mounting ring 550. Drain cover mounting ring 550 is an existing integral component of the pool drain/bottom structure defining a pair of diametrically opposed apertures 52 designed to provide an attachment structure for secure mounting of a conventional drain grate. The alternate embodiment mounting apparatus includes a generally X-shaped rigid cross member 560, having four radially projecting arms 562 and defining a centrally disposed threaded aperture 564. Cross member 560 is sized for insertion through mounting ring 550 such that each of the radially projecting arms 562 bear against the underside of mounting ring 550. Each projecting arm 562 preferably includes an end portion having gripping surfaces 564 thereon, which gripping surfaces engage the underside of mounting ring 550 when installed. Drain cover 500 is mounted over the pool drain opening and secured to cross member 560 by insertion of fastener 528 through drain cover aperture 527 for threaded engagement with aperture 564 of cross member 560. In addition, a pair of fasteners 529 are inserted through drain cover apertures 541 for direct threaded engagement with mounting ring apertures 552. Once installed cross member 560 and the various fasteners provide a secure attachment.

All of the components described herein may be fabricated from molded plastic, fiberglass, or any other suitable material, except that the fasteners are preferably stainless steel. The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A safety drain guard assembly for suction drains in pools and spas, said drain guard assembly comprising:

a drain cover, said drain cover defining a generally convex upper surface, a peripheral side wall connected to said upper surface, a peripheral base connected to said side wall;

said upper surface defining a plurality of recessed sections offset from said upper surface and completely surrounded by said upper surface so as to form recessed surfaces within said upper surface, each of said recessed surfaces defining a plurality of water inlet apertures;

said peripheral side wall defining a plurality of apertures;

means for matingly engaging said drain cover with an existing drain cover mounting ring of a suction drain of a pool or spa.

2. A safety drain guard assembly for suction drains in pools and spas according to claim 1, wherein said means for matingly engaging said drain cover with an existing drain cover mounting ring includes:

a cross member having a central portion and a plurality of arms projecting radially from said central portion;

said cross member central portion defining an internally threaded aperture, said projecting arms sized for engagement with an existing pool drain opening;

a threaded fastener sized for axial insertion through said drain cover for threaded engagement with said threaded aperture defined by said cross member.

3. A safety drain guard assembly for suction drains in pools and spas according to claim 2, wherein said drain cover peripheral base defines a pair of diametrically opposed apertures and a pair of threaded fasteners inserted through said apertures in threaded engagement with an existing drain cover mounting ring.

4. A safety drain guard assembly for suction drains in pools and spas according to claim 1, wherein said drain peripheral base includes a resilient peripheral lip.

5. A safety drain guard assembly for suction drains in pools and spas, said drain guard assembly comprising:

a drain cover, said drain cover defining a generally convex upper surface, a peripheral side wall connected to said upper surface, a peripheral base connected to said side wall;

said upper surface defining a plurality of recessed sections offset from said upper surface and completely surrounded by said upper surface so as to form recessed surfaces within said upper surface, each of said recessed sections defining a plurality of water inlet apertures, each of said inlet apertures including screen mesh;

said peripheral side wall defining a plurality of water inlet apertures, each of said apertures including screen mesh;

a cross member having a central portion defining an apertue and a plurality of arms projecting radially from said central portion, said projecting arms sized for engagement with an existing pool drain opening;

said cross member central portion further defining an internally threaded aperture;

a threaded fastener inserted axially through said drain cover in threaded engagement with said threaded aperture defined by said cross member threaded aperture thereby securing said cover to the pool drain.

* * * * *